United States Patent [19]

Collins

[11] 4,404,747

[45] Sep. 20, 1983

[54] KNIFE AND SHEATH ASSEMBLY

[75] Inventor: Walter W. Collins, Clover, S.C.

[73] Assignee: Schur, Inc., Natick, Mass.

[21] Appl. No.: 287,917

[22] Filed: Jul. 29, 1981

[51] Int. Cl.[3] ..... B26B 29/02

[52] U.S. Cl. ..... 30/151; 30/339; 224/232

[58] Field of Search ..... 30/151, 162, 339, 340; 224/232

[56] References Cited

U.S. PATENT DOCUMENTS

| | | | |
|---|---|---|---|
| 470,777 | 3/1892 | Billings | 30/162 |
| 2,005,176 | 6/1935 | Arbuckle | 30/151 X |
| 2,391,574 | 12/1945 | Housinger | 30/151 |
| 2,533,014 | 12/1950 | Jacobson | 30/339 X |
| 2,783,536 | 3/1957 | McQueary | 30/151 |
| 3,760,438 | 9/1973 | White | 30/151 |
| 4,062,118 | 12/1977 | Modafferi | 30/339 |

FOREIGN PATENT DOCUMENTS

| | | | |
|---|---|---|---|
| 670894 | 10/1929 | France | 30/162 |

*Primary Examiner*—Jimmy C. Peters

*Attorney, Agent, or Firm*—Wolf, Greenfield & Sacks

[57] ABSTRACT

A knife and sheath combination in which a spring loaded detent projects from the handle of the knife to engage an extension of the sheath whereby the knife is locked into the sheath against inadvertent removal. The knife handle is secured to the knife blade by an assembly that includes the spring loaded detent. The assembly can be removed to separate the handle and the blade for cleaning.

6 Claims, 5 Drawing Figures

10A
10
4
12
11
36
33
32
31
26
5
14
15
8
6
3
34
2
7
9
22
30
28
20
21
29
1

KNIFE AND SHEATH ASSEMBLY

SUBJECT MATTER OF THE INVENTION

The present invention relates to a means for securing a knife and a sheath against inadvertent dislodgement and to a knife assembly in which the handle and blade may be separated for cleaning or replacement.

BACKGROUND OF INVENTION

Most sheaths that have been designed for carrying knives are intended to permit the knife to be pulled quickly from the sheath. In some instances, however, the knife sheath is provided with a strap to hold the knife securely in position. In knife and sheath arrangements designed primarily for underwater use the sheath is often provided with a flexible, stretchable, rubber-like loop that extends over the handle to secure it in position While these means for securing a knife in a sheath are adequate for most purposes, they have limitations especially with a knife worn in unusual environmental situations such as occur when the knife is carried by divers. Divers require a knife and sheath combination in which the knife will remain securely in the sheath during normal movement of the diver but which can be quickly and easily removed and returned by the diver to the sheath when he wishes. While the sheath constructions heretofore in use by divers securely hold the knife in the sheath during normal movement of the diver these constructions do not ordinarily permit easy removal of the knife. The rubber ring commonly used has to be stretched or distended by the diver and since the diver works underwater and frequently in the dark it is not always easy to free the knife from the rubber ring and then remove it from the sheath. Further it is not always easy for the diver to return the knife and secure the loop over the sheath under such adverse conditions.

SUMMARY OF INVENTION

The foregoing limitations in previously available knife and sheath combinations are addressed by the present invention. In the present invention there is provided a knife and sheath combination especially adapted for use by divers. This sheath and knife combination is designed to withstand a variety of adverse conditions normally encountered underwater. Further, the sheath and knife combination of the present invention is intended to provide a knife and sheath combination of simple design that permits one-handed simple removal of a knife from a sheath without visual assistance and further permits one handed single motion return of the knife to the sheath, also without visual assistance. The sheath and knife combination of the present invention further provides a simple design that permits rapid one-handed removal of the knife from the sheath if need be. A further object of the present invention is to provide a positive locking system in which the knife is securely retained in a sheath under all circumstances of normal usage without permitting inadvertent removal of the knife. A further object of the present invention is to provide a simple construction of a knife in which the handle can easily be removed from the blade and one or the other of these components replaced. This arrangement further provides a system that allows for field stripping and servicing of the knife components.

In the present invention there is provided a knife having a handle and blade interconnected by a detent assembly that includes a spring loaded detent that projects from the handle into interfering engagement with an extension of the sheath when the knife is in the sheath. In this arrangement a force applied to the detent against the spring releases the detent from engagement with the sheath extension and permits rapid and easy removal of the knife from the sheath.

DETAILED DESCRIPTION OF THE DRAWINGS

The foregoing features of the present invention will be more clearly understood in connection with the accompanying drawings in which.

DETAILED DESCRIPTION OF THE PRESENT INVENTION

Figures 1, 2, 3, 4:
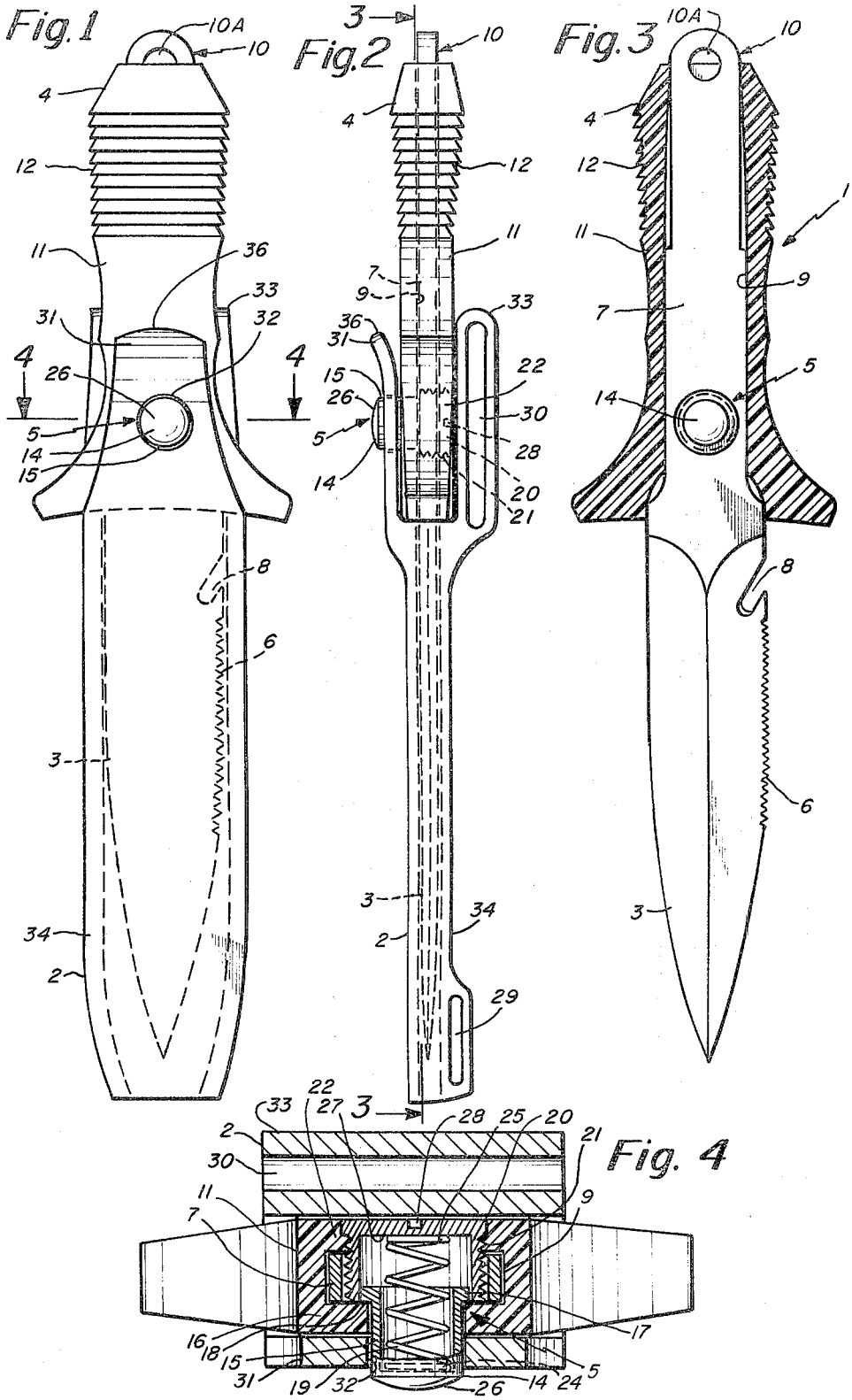
FIG.1 is an elevational view of a knife and sheath combination embodying the present invention.
FIG. 2 is a side view of the knife and sheath combination.
FIG. 3 is a cross-sectional view of the knife taken essentially along the line 3—3 of FIG. 2.
FIG. 4 is a cross-sectional detail showing the construction of the detent assembly taken essentially along the line 4—4 of FIG. 1.

Referring to the embodiment illustrated in FIGS. 1 through 4 there is shown a knife construction 1 adapted to be secured in a sheath 2. The knife 1 is formed with a blade 3, handle 4, and detent assembly 5.

The blade 3 is formed with one or more cutting edges 6 and has an integrally formed tang 7. The blade 3 may be of any conventional shape or size and may, for example, be formed with a hook 8. The tang 7 provides a handle support and preferrably should be elongated as illustrated in FIG. 3. The thickness of the tang 7 should, as illustrated in FIG. 2, be substantially no greater than the thickness of the blade 3.

The handle 4 may be made of a wide range of materials such as plastic or rubber and may be conventionally formed by molding or other suitable means to a shape having a conventional outer surface. The handle 4 is formed with a longitudinally extending opening 9 adapted to receive the tang 7. If desired the opening 9 may extend the entire length of the handle 4 so that the end of the tang remote from the blade 6 may project through the handle 4 as illustrated at 10. The handle may be formed with conventional components such as a hilt 11 and friction surface 12. The extreme end of the tang 7 may be formed with an opening 10A that at least partially projects through the handle 4 to form a loop for attachment of cables or the like.

The detent assembly 5 illustrated in FIG. 4 consists of a detent or button 14 that is cylindrical in configuration. The sidewalls 15 of this button project through a flat wall 16 of the handle. The detent is formed with an annular flange 17 that engages the inner surface of the wall 16 with an interfering face 18 to limit outward motion of the detent or button. A helical spring 19 spring loads the detent 14 outwardly into the position illustrated in FIG. 2. The helical spring 19 is secured in position by a retaining cup 20 that has a threaded wall 21 that threadably engages an opposite wall 22 of the handle. The ends 24 and 25 of the helical spring respectively engage the preferrably polished end 26 of detent 14 and end 27 of the retaining cup 20. The end 27 may be provided with a screwdriver slot 28.

The sheath 2 is formed with a blade encasing end 34 having suitable means such as loops 29 and 30 for support of the sheath on a belt or the like. The open end of the sheath 2 is formed with a hanger 31 that flares away from an opposite portion 33 of the sheath to form a wide opening or mouth to facilitate the insertion of the knife blade. The hanger 31 is also formed with an opening 32 shaped and sized to receive the detent 14 when the knife blade is inserted into the sheath.

On insertion of the knife blade 3 into the sheath 2 the handle 4 passes into the opening formed between hanger 31 and the opposite portion 33. The flared end 34 of the hanger engages the detent 14 and forces it downwardly into the handle as the knife is inserted. When the detent 14 becomes aligned with the cylindrical opening 32 in the hanger 31 the spring loaded detent 14 will pop into engagement with the opening thereby locking the knife in the sheath.

On removal the detent 14 is pushed against the spring loading until it disengages the hanger 31 thereby permitting removal of the knife. Since the handle 4 can be grasped at the same time the detent 14 is pushed with one thumb the removal requires a positive effort which, however, can be achieved with a single hand movement.

Figure 5:
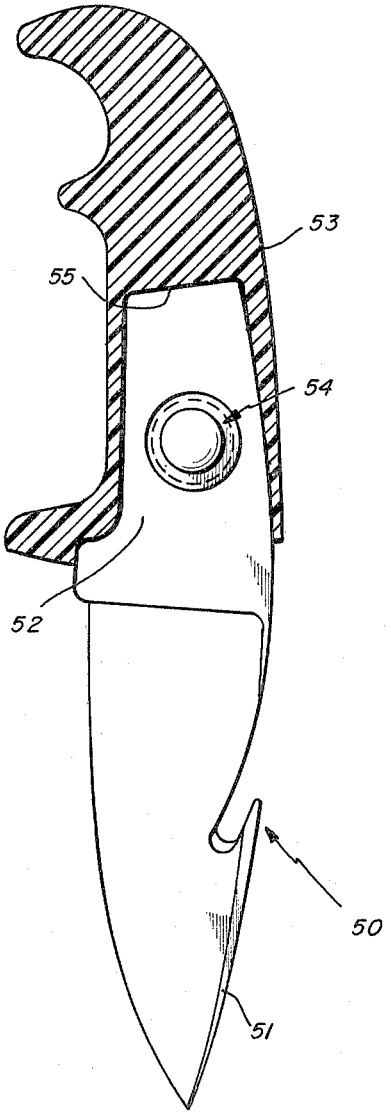
FIG. 5 is a cross-sectional elevation of a knife embodying an alternate form of the present invention.

In FIG. 5 there is illustrated a modification of the present invention in which a knife 50 consists of a blade 51 and an integrally formed tang 52. The tang 52 projects into a handle 53 that is formed of the same material as the handle of the preferred embodiment. In the present embodiment the detent generally shown at 54 also secures the blade to the handle. However, in this embodiment the tang 52 does not project all the way through handle 53 but terminates at a point 55 approximately half the length of the handle.

It should be understood that the embodiments described in the foregoing do not illustrate all of the applications for which the unique knife and sheath assembly may be suitable. It is anticipated that those skilled in the art will recognize that different types of knives may be modified to utilize the assembly of the present invention. Furthermore, alternate arrangements of the detent assemblies described herein should be expected to occur to those skilled in the art after reading the above description. All such alternate uses and modifications are intended to be included within the scope of the present invention.

Therefore, I claim and seek to obtain a patent for the following:

1. In combination a knife having a handle and blade and a sheath having a knife encasing portion and a hanger extending therefrom, means for securing said knife in said sheath comprising:

a detent assembly;

means supporting said detent assembly in said handle, said supporting means removably engaging said handle and a blade extension into said handle whereby removal of said supporting means permits separation of said blade and handle;

means spring loading a detent and forming a portion of said detent assembly to partially project from said handle;

means forming a hole in said hanger into which said detent projects when said knife is in said sheath, whereby said detent engages said hanger to prevent removal of said knife from said sheath unless said detent is pushed against said spring pressure to disengage it from said hanger while said knife is being withdrawn from said sheath.

2. A combination as set forth in claim 1 wherein said spring loading means comprises a helical spring aligned with said detent and contained within said handle.

3. A combination as set forth in claim 1 wherein said sheath comprises a blade encasing portion and a hanger having an end extending from said blade encasing portion and flared outwardly from the opposite side of said sheath to form an open mouth adapted to receive said knife.

4. In combination a knife having a handle and blade and a sheath having a knife encasing portion and a hanger extending therefrom, means for securing said knife in said sheath comprising:

a detent assembly;

means supporting said detent assembly in said handle;

means spring loading a detent and forming a portion of said detent assembly to partially project from said handle;

means forming a hole in said hanger into which said detent projects when said knife is in said sheath, whereby said detent engages said hanger to prevent removal of said knife from said sheath unless said detent is pushed against said spring pressure to disengage it from said hanger while said knife is being withdrawn from said sheath;

said detent having a cylindrical wall projecting from one face of said handle and said detent assembly having means for limiting outward movement of said detent, said spring comprising a helical spring positioned within said detent assembly and having one end engaging an innersurface of said detent and the other end engaging a cup, said cup threaded into and secured in said handle.

5. A combination as set forth in claim 4 wherein said cup threadably engages said handle and an integral extension of said blade into said handle whereby disengagement of said cup permits separation of said blade and handle.

6. In combination a knife having a handle and blade and a sheath having a knife encasing end and a hanger extending therefrom, a detent assembly for securing said knife in said sheath and said blade in said handle comprising:

a tang integral with said blade;

a longitudinal opening within said handle for receiving said tang;

a detent assembly having a cylindrical detent, an annular flange integral with said cylindrical detent, a retaining cup threadably engaging said handle, a helical spring held between said retaining cup and said detent, said cup slidingly receiving said detent;

a hole in said tang located to receive said cup when said longitudinal opening receives said tang;

a circular opening in said handle opposite said hole in sliding contact with said detent;

a hanger integral with said sheath;

an opposing portion opposite said hanger also integral with said sheath;

said hanger and said opposing portion forming a diverging blade receiving opening for said blade encasing portion;

a detent receiving opening in said hanger, whereby inserting said blade into said blade encasing portion causes contact between said detent and said opposing portion to urge said detent against said spring thereby depressing said detent into said handle until said detent and said detent receiving opening align and said detent enters said opening to hold said knife in said sheath until depressing said detent, and said blade being removable from said handle after removal of said cup from said tang and handle.

* * * * *